United States Patent [19]

Bustos

[11] Patent Number: 4,593,826

[45] Date of Patent: Jun. 10, 1986

[54] DISPLAY RACK WITH IMPROVED SHELF MOUNTS

[75] Inventor: Rafael T. Bustos, Alpharetta, Ga.

[73] Assignee: Leggett & Platt, Incorporated, Carthage, Mo.

[21] Appl. No.: 655,329

[22] Filed: Sep. 27, 1984

[51] Int. Cl.[4] ..... A47B 47/00

[52] U.S. Cl. ..... 211/187; 211/208; 108/144

[58] Field of Search ..... 211/187, 186, 208; 108/144, 111

[56] References Cited

U.S. PATENT DOCUMENTS

| | | | |
|---|---|---|---|
| Re. 28,293 | 1/1975 | Bustos . | |
| 3,343,685 | 9/1967 | Giambalvo . | |
| 3,424,111 | 1/1969 | Maslow | 108/144 |
| 3,523,508 | 8/1970 | Maslow | 108/144 |
| 3,604,369 | 9/1971 | Maslow | 108/144 |
| 3,664,274 | 5/1972 | Bustos | 108/144 |
| 3,874,511 | 4/1975 | Maslow | 108/144 X |
| 4,064,995 | 12/1977 | Bustos | 211/187 |
| 4,138,953 | 2/1979 | Tashman | 108/144 |
| 4,318,352 | 3/1982 | Friedman et al. | 108/111 |

*Primary Examiner*—Ramon S. Britts
*Assistant Examiner*—Blair M. Johnson
*Attorney, Agent, or Firm*—Wood, Herron & Evans

[57] ABSTRACT

A display rack in which a plurality of shelves are mounted at desired locations along vertical corner posts by wedge lock elements. Each wedge lock element comprises a two-piece, wedge-shaped insert having outwardly extending projections which are adapted to releasably mount within dimples or detents vertically spaced along the corner posts. The shelves are formed with a sleeve at each corner adapted to fit over the corner posts and into engagement with the inserts. The inserts become wedged between the corner posts and sleeves to prevent downward vertical motion of the shelves relative to the corner posts while permitting easy removal of the shelves by lifting them upwardly from the inserts for disassembly or movement to a new position along the corner posts.

3 Claims, 5 Drawing Figures

DISPLAY RACK WITH IMPROVED SHELF MOUNTS

BACKGROUND OF THE INVENTION

This invention relates to adjustable display racks, and, more particularly, to a wedge locking arrangement for adjustably mounting a shelf vertically along the corner posts of a display rack.

Display racks for merchandising and other display purposes having shelves which are vertically adjustable along the corner posts are well-known in the art. Vertically adjustable shelves provide flexibility in the display of different sized articles, allowing merchandisers to use the same display rack for a variety of articles.

Early designs of adjustable display racks employed set screws or bolts to connect the corner posts and shelves. Threaded bores or apertures were formed in either the shelf or corner post, or both, and the bolts or screws were tightened within the threaded bores to secure the shelves in place at spaced locations along the corner posts. Although this design provides for adjustment of the shelves vertically along the corner posts, an inordinate amount of time is required to remove all of the bolts connecting each shelf to a corner post and then reposition them at other locations along the corner posts. In addition, the threaded connections are subject to being over or under tightened, and as a result, the threads formed in either the bolt or threaded bores in the shelf or corner posts can become worn.

In an effort to lessen the time required to adjust the location of shelves along the corner posts of a display rack, and to provide a connection between the corner posts and shelves which is less susceptible to wear, corner post-shelf connections employing a wedge lock element have been developed, as shown, for example, in U.S. Pat. Nos. 3,424,111 and 3,343,685. In designs of this type, a sleeve is formed in each corner of the shelf structure which is adapted to receive a corner post. A wedge-shaped locking element or insert is adapted to mount at desired vertical locations along each of the corner posts before the shelves are moved into place. A shelf is releasably mounted to the corner posts by moving the sleeves of the shelf vertically downwardly along the corner posts and into contact with the wedge-shaped inserts. The insert becomes wedged between the sleeve and corner post preventing further downward movement of the shelf therealong. Adjustment of the location of a shelf is accomplished by lifting vertically upwardly on the shelf so that the sleeves disengage the inserts, and then placing the inserts at another desired location along the corner posts.

The wedge-type connections between the shelves and corner posts of known display racks have proved to be both durable and quickly adjustable for disassembly of the display rack or repositioning of the shelves. Nevertheless, certain disadvantages are present in the construction of the wedge-shaped inserts, and in their connection to the corner posts. For example, in U.S. Pat. No. 3,424,111, the wedge-shaped inserts are formed in two separate pieces which are connected to one another by a spring clip. A second spring clip is required to locate and mount the assembled wedge-shaped inserts in the proper position along the corner posts in preparation for receiving the shelves. This design increases the number of pieces required for assembly of the inserts, and for mounting them to the corner posts, which adds to manufacturing costs and increases the difficulty of initially mounting the shelves and then moving them from one position along the corner posts to another.

SUMMARY OF THE INVENTION

It is an objective of this invention to provide a display rack having a wedge lock element for mounting the shelves along the corner posts which is durable, easily adjustable at any desired location along the length of the corner posts, and employs a minimum of parts to reduce manufacturing costs and simplify installation.

The display rack of this invention includes a plurality of shelves having a sleeve element at each corner, four corner posts for supporting the shelves which are adapted to extend through the sleeve elements, and a plurality of wedge lock insert assemblies releasably mounted at desired locations along the corner posts. The insert assemblies are adapted to be received within the sleeve elements of the shelves and form a wedge between the sleeves and corner posts to releasably secure the shelves to the corner posts.

The wedge lock insert assemblies include first and second wedge elements, each having top, bottom and opposed side edges. Both wedge elements taper outwardly from top to bottom so that their top edge has a smaller cross section than their bottom edge. A tongue is formed in one of the wedge elements which extends laterally outwardly from one of its side edges, and the other wedge element is formed with a groove adjacent to one of its side edges. The tongue of one wedge element is adapted to snap-fit within the groove of the other wedge element to releasably interconnect the wedge elements generally perpendicularly to one another.

Means are provided for locating the insert assemblies vertically along the corner posts and for releasably mounting them to the corner posts when the shelves are not in place. The locating means comprises projections formed on the insert assemblies which are adapted to engage dimples or detents formed in the corner posts. In a preferred embodiment of this invention, a plurality of pairs of detents are formed at spaced intervals along the length of the corner post. Each pair of detents is formed in substantially the same horizontal plane, with one detent being formed in each of two adjacent sides of the corner post. The wedge elements of the insert assemblies are each formed with a projection extending outwardly therefrom. The projections of the wedge elements are adapted to seat within the corner post detents so as to locate the insert assemblies in the desired vertical position along the corner posts, and to releasably secure them to the corner posts when the shelves are not in place.

The first and second wedge elements of the insert assemblies are each formed with a lip extending generally perpendicularly from their side edges opposite the tongue and groove connection therebetween. The lips are adapted to wrap around the edges of the corner posts to aid in securing the insert assemblies thereto.

The wedge insert elements of the insert assemblies are preferably formed of rigid plastic in a single molding operation. No external clips or other elements are required to secure the insert elements together or to mount the insert assemblies to the corner posts. This two-piece configuration of the insert assemblies herein reduces manufacturing costs and simplifies assembly or disassembly of the display rack as compared to prior art connections between the shelves and corner posts of adjustable display racks.

DESCRIPTION OF THE DRAWINGS

The structure, operation and advantages of this invention will become further apparent upon consideration of the following discussion taken in conjunction with the accompanying drawings, wherein.

DETAILED DESCRIPTION OF THE INVENTION

Figure 2:
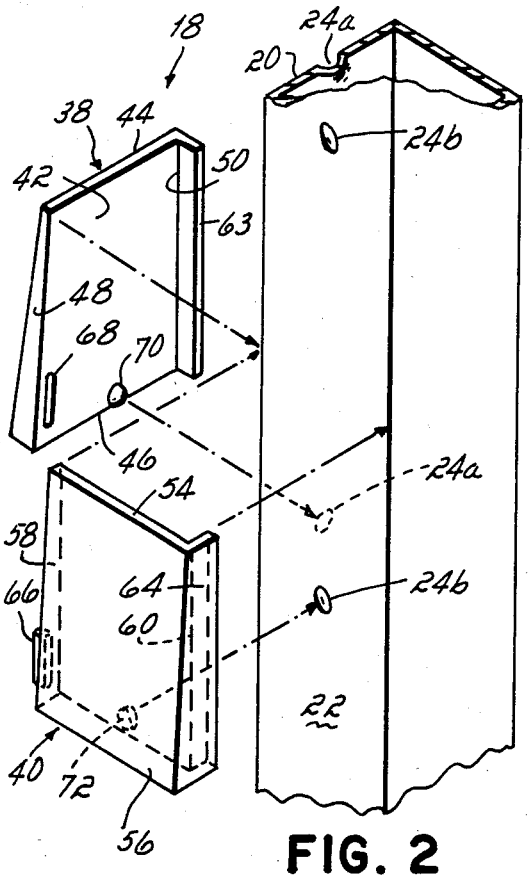
FIG. 2 is an exploded, partial perspective view of the connection between one embodiment of an insert assembly, and a corner post.
Figure 3:
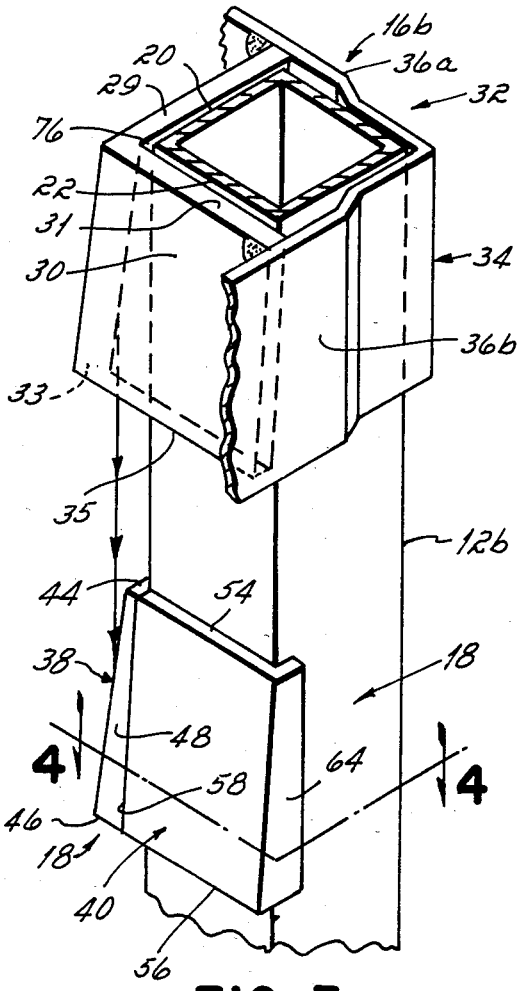
FIG. 3 is a partial perspective view of a portion of a shelf structure disposed along a corner post just prior to engagement with the insert assembly of the embodiment shown in FIG. 2.
Figure 4:
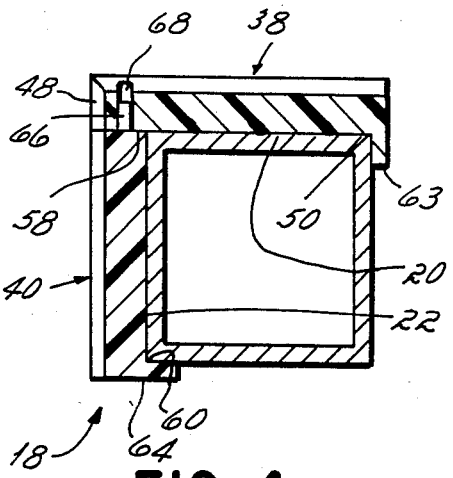
FIG. 4 is a partial cross-sectional view taken generally along line 4—4 of FIG. 3.

Referring now to the drawings, a display rack 10 includes four corner posts 12*a–d* adapted to support shelves 14*a–c*. The shelves 14*a–c* are each formed with sleeves 16*a–d* at the corners which are movable along the corner posts 12*a–d*, respectively. The shelves 14*a–c* are supported at desired vertical locations along corner posts 12*a–d* by insert assemblies 18 releasably mounted to the corner posts 12*a–d* as shown in FIGS. 2–4. As discussed below, the sleeves 16*a–d* of each shelf 14*a–c* are adapted engage the insert assemblies 18 which form a wedge between the sleeves 16*a–d* and corner posts 12*a–d* to prevent downward movement of the shelves 14*a–c* along the corner posts 12*a–d*. The shelves 14*a–c* are removed from the corner posts 12*a–d* for disassembly or repositioning by lifting them vertically upwardly from the insert assemblies 18.

Figure 1:
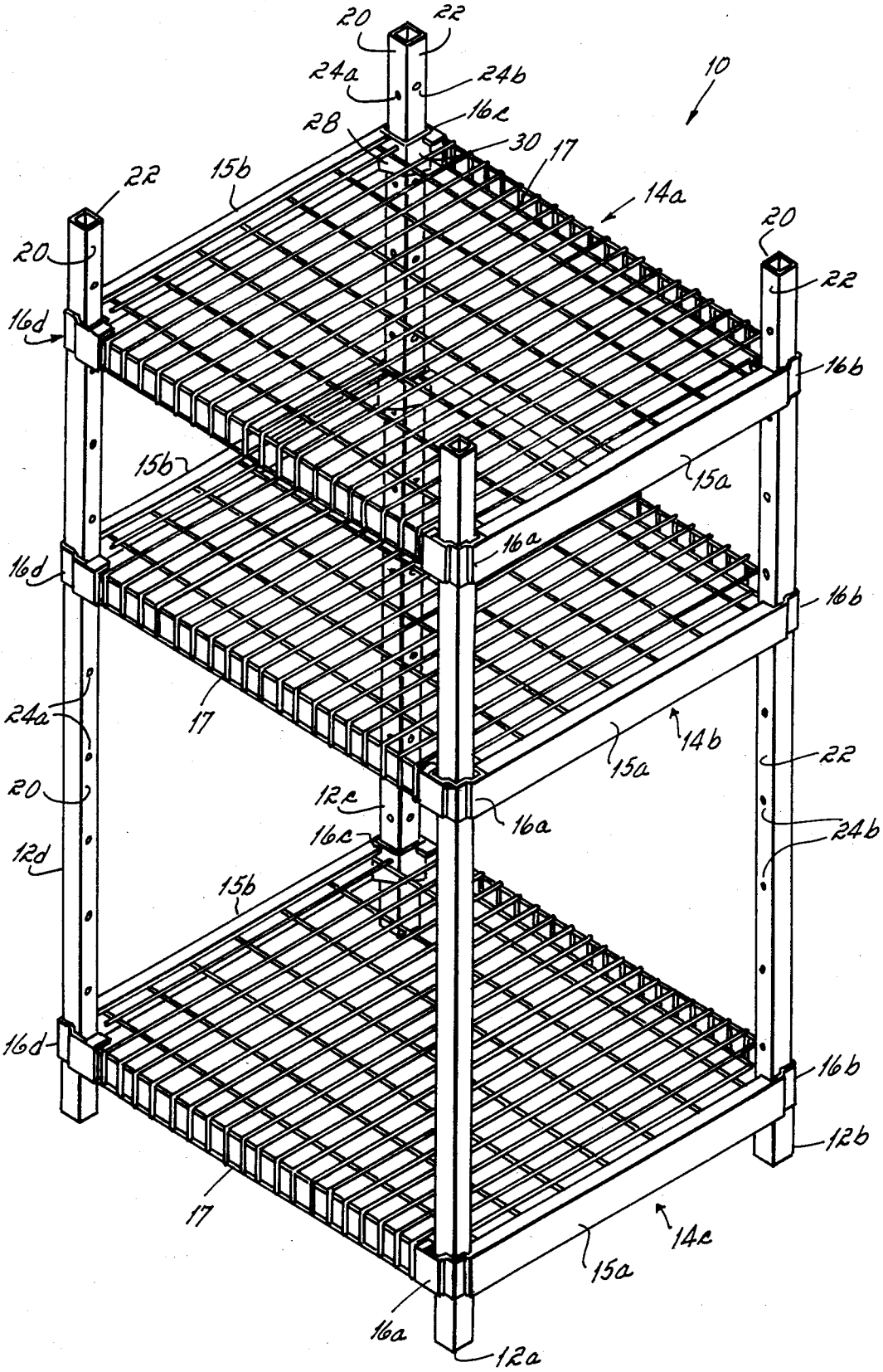
FIG. 1 is a partial perspective view of a display rack incorporating the shelf-corner post connection of this invention.

As shown in FIGS. 1, 2 and 3, the corner posts 12*a–d* are preferably square in shape and have two adjacent sides 20,22 which face inwardly toward the shelves 14*a–c*. A plurality of pairs of detents or dimples 24*a,b* are spaced along the length of each corner post 12*a–d*. Each pair of dimples 24*a,b* lies in generally the same horizontal plane with one dimple 24*a* being formed in side 20 of corner posts 12*a–d* and the other dimple 24*b* being formed in the adjacent side 22. The dimples 24*a,b* extend inwardly from the surface part way into the corner post sides 20,22 in the embodiment shown in the drawings. Alternatively, the dimples 24*a,b* could be replaced with bores extending completely through the corner post sides 20,22. As discussed in detail below, the dimples 24*a,b* help locate and support the insert assemblies 18 along the corner posts 12*a–d*.

Each shelf 14*a–c* includes spaced side panels 15*a* and 15*b*, and a cross wire support surface 17 which extends between and is mounted to the side panels 15*a,b* by welding or brazing. The sleeves 16*a–d* are mounted to or integrally formed at the ends of side panels 15*a,b*, which form the four corners of shelves 14*a–c*, with sleeves 16*a,b* being disposed at opposite ends of side panel 15*a* and sleeves 16*c,d* being disposed at opposite ends of panel 15*b*. In the embodiment shown in FIGS. 1, 2 and 3, the sleeves 16*a–d* each include adjacent sides 28,30 which face inwardly toward the wire support surface 17, and sides 32,34 which face outwardly from the wire support surface 17. The outwardly facing sides 32, 34 are formed with an offset section 36*a,b*, respectively, for purposes to become apparent below. In addition, the inwardly facing sides 28, 30 taper outwardly from top to bottom so that their top edges 29, 31, respectively, are narrower than their bottom edges 33, 35. In an alternative embodiment shown in FIG. 4, the sleeves 16*a–d* are formed with outer sides 32*a*, 34*a* having no offset so that the sleeves 16*a–d* are substantially square in configuration. As discussed below, the sleeves 16*a–d* of either embodiment are each adapted to receive an insert assembly 18 which wedges between the corner posts 12*a–d* and sleeves 16*a–d* to secure the shelves 14 along the corner posts 12*a–d*.

Referring now to FIG. 2, the insert assemblies 18 in one embodiment of this invention are formed in two separate pieces including a first wedge element 38 and a second wedge element 40. The first wedge element 38 includes top and bottom edges 44,46 and side edges 48,50, and the second wedge element 40 includes top and bottom edges 54,56 and side edges 58,60. Both of the wedge elements 38,40 taper outwardly from top to bottom so that the cross-sectional area at their top edges 44,54 is less than the cross-sectional area at their bottom edges 46,56. Wedge element 38 is formed with a lip 63, which extends generally perpendicularly from its side edge 50, and the second wedge element 40 includes a lip 64 extending outwardly perpendicular to its side edge 60.

Figure 5:
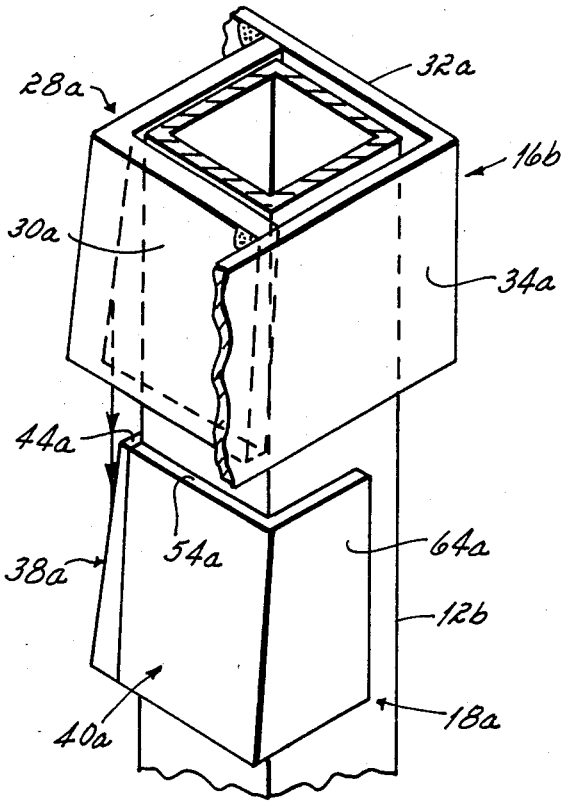
FIG. 5 is a partial perspective view of a portion of a shelf structure disposed along a corner post just prior to engagement with an alternative embodiment of the insert assembly herein.

The wedge elements 38,40 are interconnected at their opposite sides 48,58 by a tongue and groove arrangement as shown in FIGS. 2 and 5. A tongue 66 is formed in the second wedge element 40 and extends laterally outwardly from its side edge 58. A mating slot or groove 68 is formed in the first wedge element 38 adjacent its side edge 48. The tongue 66 is adapted to releasably snap-fit within the groove 68 to interconnect wedge elements 38,40 generally perpendicularly to one another forming an assembled insert assembly 18. In order for the side edge 48 of first wedge element 38 to be flush with the side edge 58 of second wedge element 40 when the wedge elements 38,40 are assembled, the first wedge element 38 is wider at its bottom edge 46 than the top edge 44 (see FIG. 2). This is required because the wedge elements 38,40 increase in cross section from top to bottom. Therefore, as shown in FIG. 3, the insert assemblies 18 increase in cross section from top to bottom and are wider at the bottom than the top.

The wedge elements 38,40 each include an outwardly extending stud or projection 70,72, respectively. The projections 70,72 of the wedge elements 38,40 of insert assemblies 18 and the detents 24*a,b* formed in the sides 20,22 of corner posts 12*a–d* provide a means for locating the insert assemblies 18 in the desired vertical position along the corner posts 12*a–d*, and also aid in releasably mounting the insert assemblies 18 thereto when the shelves 14 are not in position. As shown in FIGS. 1 and 2, when the wedge elements 38,40 are assembled, they are adapted to mount to the corner posts 12*a–d* so that the projection 70 seats within the detent 24*a* formed in the corner post side 20, and the projection 72 seats within the detent 24*b* formed in the corner post side 22. The lips 63,64 of wedge elements 38,40 extend around the edges of the corner post sides 20,22, respectively. The insert assemblies 18 are positioned at the desired location along corner posts 12*a–d* by selecting one of the pairs of detents 24*a,b*. The engagement between the projections 70,72 of insert assemblies 18 and the detents 24*a,b*, in combination with the engagement of lips 63,64 of the insert assemblies 18 with the sides 20,22 of the corner posts 12*a–d*, allows the insert assemblies 18 to mount along the corner post 12*a–d* when the shelves 14*a–c* are not in place. As shown in FIG. 3, the insert assemblies 18 are oriented along corner posts 12*a–d* so that their top edges 44,54 extend vertically above the bottom edges 46,56 and thus taper outwardly relative to the sides of corner posts 12*a–d* from top to bottom.

Referring now to FIGS. 1 and 3, the connection between the sleeve element 16*b* of shelf 14*b* and an insert assembly 18 mounted to corner post 12*b* is shown to illustrate the wedge lock mounting feature of this invention. Each corner of shelves 14*a–c* is mounted along corner posts 12*a–d* in the same manner. The shelf 14*b* is positioned so that its sleeve element 16*b* aligns with the corner post 12*b*, and then travels vertically downwardly with the corner post 12*b* moving within the sleeve element 16*b*. At the location where the insert assembly 18 is mounted to corner post 12*b*, the sleeve element 16*b* initially slides over the top edges 44,54 of the insert assemblies 18 (as shown by arrows) but then engages the insert assembly 18 as its cross-sectional area increases toward the bottom edges 46,56. Further downward movement of the shelf 14*b* is prevented because the insert assembly 18 becomes wedged between the sleeve element 16*b* and corner post 12*b*. This occurs where the thickness of the insert assembly 18 is equal or greater to the space between corner posts 12*b* and sleeve element 16*b*.

As shown in the embodiment of FIG. 3, the offsets 36*a,b* formed in the sides 32,34 of sleeve 16*b* are adapted to receive the lips 63,64, respectively, of the insert assembly 18 to prevent interference therebetween. The remaining portion of sides 32,34 contact corner post 12*b*. In addition, the configuration of the inwardly facing sides 28,30 of sleeve 16*b* enhances the engagement between sleeve 16*b* and insert assembly 18. As described above, sides 28,30 of sleeve 16*b* increase in width from their top edges 29,31 to their bottom edges 33,35, respectively. The sides 28,30 of sleeve 16*b* therefore conform in shape to the wedge elements 38,40 of insert assembly 18. When the sleeve 16*b* is placed over the insert assembly 18, substantially the entire surface of sides 28,30 of sleeve 16*b* engage the wedge elements 38,40, respectively. Such surface-to-surface contact provides secure engagement between the sleeve 16*b* and insert assembly 18 to prevent the shelf 14*b* from moving vertically downwardly along the corner post. Preferably, the space 76 between the corner post 12*b* and sleeve 16*b* is sufficient to permit the sleeve 16*b* to extend along the entire length of insert assembly 18 with the shelf 14*b* in place.

In order to remove any of the shelves 14*a–c* from the insert assemblies 18, the shelves 14*a–c* are simply lifted upwardly along the corner posts 12*a–d*. The shelves 14*a–c* can then be easily repositioned along corner posts 12*a–d*, by removing the insert assemblies 18 from one position and moving them to another location where other pairs of detents 24*a,b* are formed in corner posts 12*a–d*.

Referring to FIG. 4, an alternative embodiment of the invention is shown. In this embodiment, an insert assembly 18*a* is provided which is identical to insert assembly 18 except the wedge elements 38*a*,40*a* are formed with a wider lip 63*a*,64*a*, respectively and the sides 32*a*, 34*a* of the sleeve 16*b* are flat rather than offset as in the first embodiment. The two-piece, snap fit insert assembly 18*a* is mounted to corner post 12*b* in the same manner as insert assembly 18, described above. The insert assemblies differ only in that the lips 63*a*,64*a* extend further along the sides 20,22 of corner post 12*b* than lips 63,64. This provides additional support for insert 18*a* for mounting to corner post 12*b* when the shelf 14*b* is not in place. In addition, the sleeve 16*b* of this embodiment is formed with outer sides 32*a*,34*a* having no offset 36. The cross-sectional area of sleeves 16*b* is therefore large enough to fit over the top edges 44*a*,54*a* of inserts 18*a*, and the outer sides 32*a*,34*a* of sleeve 16*b* do not contact the corner posts 12*b*. The shelf 14*b*, and shelves 14*a,c*, are supported along corner posts 12*a–d* by insert assemblies 18*a* in the same manner as insert assemblies 18, as described above.

While the invention has been described with reference to two preferred embodiments, it will be understood by those skilled in the art that various changes may be made and equivalents may be substituted for elements thereof without departing from the scope of the invention. In addition, many modifications could be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

1. An adjustable display rack comprising:

a shelf having a sleeve element mounted at each corner;

corner posts for supporting said shelf, each of said corner posts being adapted to extend through said sleeve elements of said shelf;

an insert assembly adapted to releasably mount to each of said corner posts, said insert assembhly including a first wedge element and a second wedge element each having top, bottom and side edges, said first and second wedge elements each having a lip formed on a side edge thereof, said first and second wedge elements increasing in cross section from said top edge to said bottom edge, one of said first and second wedge elements having a tongue extending laterally outwardly from one of said side edges, the other of said first and second wedge elements having a groove formed therein, said tongue being adapted to snap-fit within said groove to releasably connect said first and second wedge elements generally perpendicularly to one another;

locating means for locating said insert assembly along said corner post, said locating means including a pair of spaced dimples formed in said corner post, and a projection extending outwardly from each of said first and second wedge elements of said insert assembly, said projections of said wedge elements being adapted to seat within said dimples formed in said corner post for locating said insert assembly along said corner post;

said lips of said wedge elements engaging said corner posts and said projections of said wedge elements seating within said dimples formed in said corner posts to releasably secure said insert assembly to said corner posts such that said top edge of said first and second wedge elements is disposed vertically above said bottom edge thereof;

said insert assemblies being adapted to wedge between said sleeve element at each corner of said shelf and said corner posts for supporting said shelf along said corner posts, said insert assembly preventing downward movement of said shelf along said corner posts while permitting said shelf to be lifted vertically upwardly from said insert assembly along said corner posts for repositioning said shelf.

2. The display rack of claim 1 in which said sleeve elements of said shelves are generally rectangular having four sides, two adjacent sides of said sleeve elements being formed with an offset section at one end, said offset sections being adapted to receive said lip sections of said first and second wedge elements of said insert assembly upon insertion of said insert assembly within said sleeve elements.

3. The display rack of claim 1 in which said sleeve elements are rectangular.

* * * * *